US005820400A

United States Patent [19]

Yamanashi et al.

[11] Patent Number: 5,820,400

[45] Date of Patent: Oct. 13, 1998

[54] HALF-FITTING PREVENTING CONNECTOR

[75] Inventors: Makoto Yamanashi; Nobuyuki Akeda, both of Shizuoka, Japan

[73] Assignee: Yazaki Corporation, Tokyo, Japan

[21] Appl. No.: 770,813

[22] Filed: Dec. 20, 1996

[30] Foreign Application Priority Data

Dec. 22, 1995 [JP] Japan ..... 7-335159

[51] Int. Cl.[6] ..... H01R 13/627

[52] U.S. Cl. ..... 439/358

[58] Field of Search ..... 439/353, 354, 439/357, 358

[56] References Cited

U.S. PATENT DOCUMENTS

| | | | |
|---|---|---|---|
| 5,380,223 | 1/1995 | Marsh et al. | 439/610 |
| 5,664,961 | 9/1997 | Tsuji et al. | 439/358 |
| 5,672,071 | 9/1997 | Ceru | 439/354 |

FOREIGN PATENT DOCUMENTS

| | | | |
|---|---|---|---|
| 5-43484 | 6/1993 | Japan | H01R 13/639 |

*Primary Examiner*—Neil Abrams
*Assistant Examiner*—Yong Ki Kim
*Attorney, Agent, or Firm*—Sughrue, Mion, Zinn, MacPeak & Seas, PLLC

[57] ABSTRACT

An imperfect-fitting preventing connector comprising a suitable number of engagement mechanisms 4 by which male and female connectors 2 and 3 are engaged with each other in a perfect-fitting position, a suitable number of lock mechanisms 5 for locking the engagement mechanisms 4 in the perfect-fitting position, and elastic members 6 for holding the lock mechanisms 5 while urging the lock mechanisms 5 in the perfect-fitting position, wherein the engagement mechanisms 4 include an inflexible engagement projection 7 provided on an outer circumferential surface of the male connector 2, and an engagement hole 11 provided in a lock member 10 which is provided in an outer housing 9 which is axially slidable on an outer circumferential surface of an inner housing 8 of the female connector 3.

11 Claims, 6 Drawing Sheets

HALF-FITTING PREVENTING CONNECTOR

BACKGROUND OF THE INVENTION

1. Field of the Invention

The present invention relates to an half-fitting preventing connector in which fitting between male and female connectors is released when the connectors are left in a half-fitting state while the male and female connectors in a perfect-fitting state are locked securely.

2. Related art

As half-fitting preventing connectors, various connectors are known conventionally. For example, there is known a half-fitting preventing connector disclosed in Japanese Utility Model Unexamined Publication No. Hei-5-43484, etc.

As shown in FIG. 9, a half-fitting preventing connector 51 comprises: a pair of engagement mechanisms 54 by which male and female connectors 52 and 53 to be fitted/connected to each other are engaged with each other in a perfect-fitting position; a pair of lock mechanisms 55 for locking the engagement mechanisms 54 in the perfect-fitting position; and a compression spring 56 for holding the lock mechanisms 55 in the perfect-fitting position. The engagement mechanisms 54 include: a movable engagement projection 57 formed from a synthetic resin material and provided on an inner circumferential surface of the male connector 52; and a circumferential groove-like engagement groove 61 provided in an outer circumferential surface of an inner housing 58 of the female connector 53.

Further, the aforementioned lock mechanisms 55 include: a circumferential projection-like tilting projection 65 provided on the outer circumferential surface of the inner housing 58 and located at a front end of the aforementioned engagement groove 61; a ring-like lock member 60 which is axially slidable on an inner circumferential surface of an outer housing 59 which surrounds the outer circumference of the inner housing 58; and a compression spring 56 attached on the inner circumference of the outer housing 59 to urge the lock member 60 forward.

Incidentally, a grip member 66 for pressing the female connector 53 toward the male connector 52 is integrally assembled on the rear portion of the inner housing 58, and the outer housing 59 is integrally assembled on the front of the grip member 66 through the compression spring 56. Further, not-shown slits are provided in an axial direction in a housing 67 at opposite sides of the engagement projection 57 so that the engagement projection 57 is bent in the outer circumferential direction so as to be able to be tilted when the engagement projection 57 is pushed up by the tilting projection 65.

In the aforementioned configuration, when the grip member 66 of the female connector 53 is pushed toward the male connector 52 while being gripped, the engagement projection 57 is first brought into contact with the tilting projection 65 and then is tilted outward so that the housing 67, at the front end of the engagement projection 57, is brought into contact with the front end of the lock member 60.

Accordingly, the lock member 60 is pushed backward against the urging force of the compression spring 56. If the gripping is released in such an half-fitting state, the male and female connectors 52 and 53 are disconnected by the urging force of the compression spring so that the half-fitting is prevented.

When the female connector 53 is further continuously pushed toward the male connector 52, the engagement projection 57 is engaged with the engagement groove 61 so that the state of the engagement projection 57 returns from a tilted state to an axially parallel state. As a result, the housing 67 is disconnected from the lock member 60, so that the lock member 60 is pushed forward by the urging force of the compression spring 56. Accordingly, because the engagement projection 57 is engaged with the engagement groove 61 so that the engagement projection 57 cannot be tilted outward, the male and female connectors 52 and 53 are locked in a perfect-fitting state.

In the aforementioned half-fitting preventing connector 51, there however arises a problem that the lock member 60 is disconnected from the engagement projection 57 so that the engagement projection 57 rides over the tilting projection 65 so as to be disconnected from the engagement groove 61 when the outer housing 59 of the male and female connectors 52 and 53 perfectly fitted to each other is pushed backward against the urging force of the compression spring 56 by an external force.

Furthermore, because the engagement projection 57 is provided in the inside of the housing 67 and the lock member 60 is also provided in the inside of the outer housing 59, there is another problem that the perfect-fitting state of the male and female connectors 52 and 53 cannot be confirmed from the outside.

Furthermore, in the case where the male connector 52 is directly fixed to an apparatus, the synthetic resin material is hardened so that the engagement projection 57 cannot be bent so as to be tilted. Accordingly, there arises a further problem that the aforementioned operation cannot be carried out.

Furthermore, because the tilting projection 65 for tilting the engagement projection 57 is provided on the inner housing 58, there arises a further problem that a clearance is required between the tilting projection 65 and the inner circumferential surface of the outer housing 59 so that the housing becomes large in size.

SUMMARY OF THE INVENTION

Taking the aforementioned problems into consideration, an object of the present invention is to provide an half-fitting preventing connector in which: a perfect-fitting state can be confirmed from the outside; lock mechanisms and engagement mechanisms are not released by any external force; the connector can be adapted to a partner connector which is directly fixed to an apparatus; and reduction in size can be attained.

The foregoing object of the present invention can be achieved by an half-fitting preventing connector comprising: engagement mechanisms for making male and female connecters, which are to be fitted/connected to each other, engage with each other in a perfect-fitting position; lock mechanisms for locking the engagement mechanisms in the perfect-fitting position, and elastic members for holding the lock mechanisms in the perfect-fitting position; characterized in that the engagement mechanisms include an inflexible engagement projection provided on an outer circumferential surface of the male connector, and an engagement hole provided in a lock member which is provided in an outer housing axially slidable on an outer circumference of an inner housing of the female connector.

According to the half-fitting preventing connector configured as described above, because the engagement projection is provided on the outer circumferential surface of the male connector and the engagement hole is provided in the lock member provided in the outer housing of the female connector, the perfect-fitting state can be confirmed from the outside. Furthermore, because the engagement projection is inflexible and may be formed from a hard synthetic resin material, it can be applied also to a male connector of the type which is directly fixed to an apparatus.

Further, the foregoing object can be achieved the lock mechanisms including the lock member which is held in the outer housing so as to be able to be tilted and which has a tilting groove in its inner surface, a lock member tilting projection which is provided on the outer circumferential portion of the inner housing, and the elastic member which is attached so as to urge the outer housing toward the front of the inner housing.

According to the half-fitting preventing connector configured as described above, because the lock member is not tilted by any means other than the tilting projection, the lock mechanisms in a perfect-fitting state is never released by any external force. Furthermore, because the lock member is held in the outer housing so as to be able to be tilted but does not project from the inner circumferential portion of the outer housing, a clearance is not required between the inner housing and the outer housing so that reduction in size of the connector can be attained.

Furthermore, because a taper surface is provided on a front end of the tilting groove, the lock member can be tilted smoothly by the tilting projection as the connectors are fitted to each other.

DETAILED DESCRIPTION OF THE PREFERRED EMBODIMENTS

Figure 1:
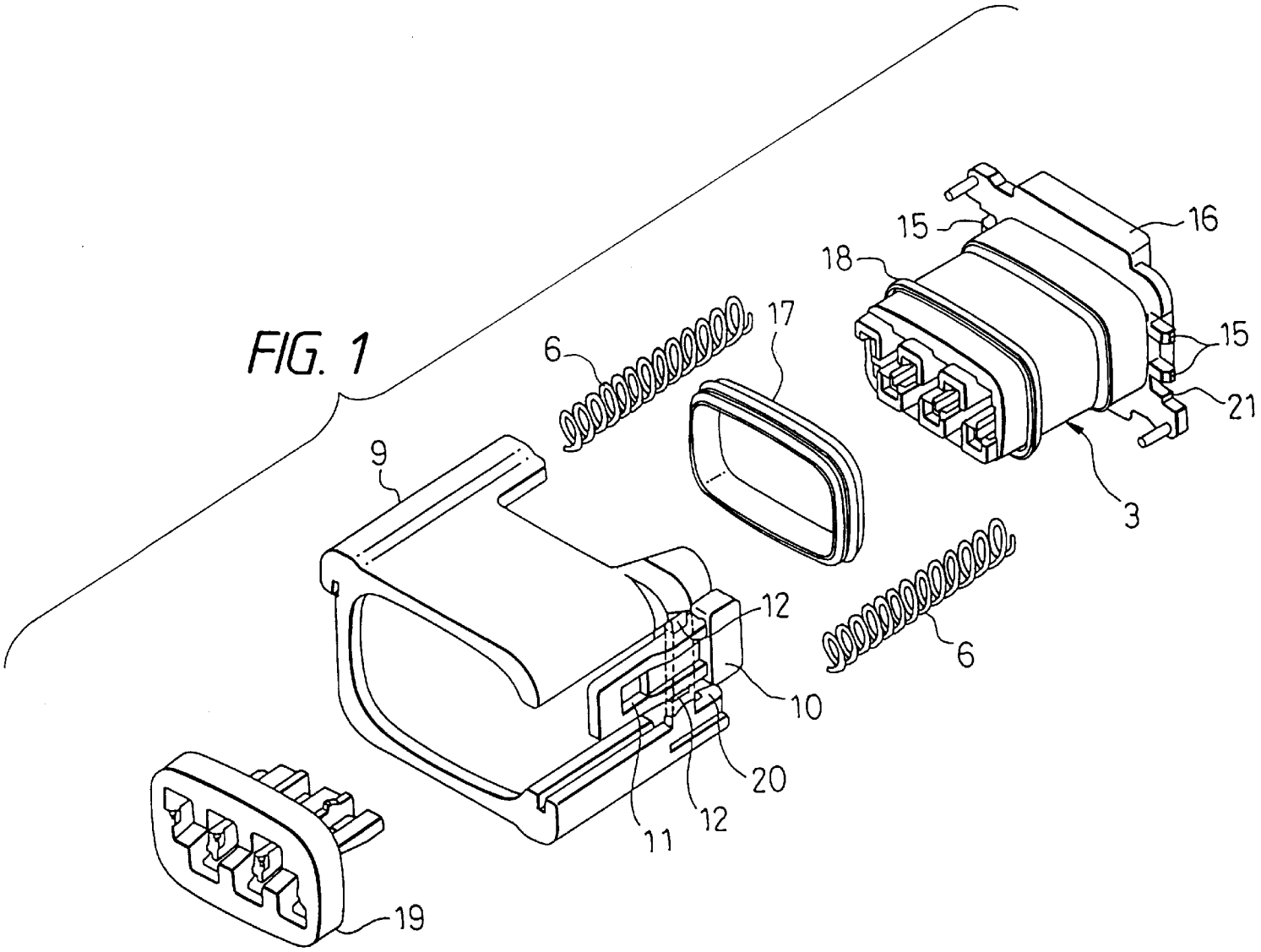
FIG. 1 is an exploded perspective view showing an embodiment of the half-fitting preventing connector according to the present invention.
Figure 2:
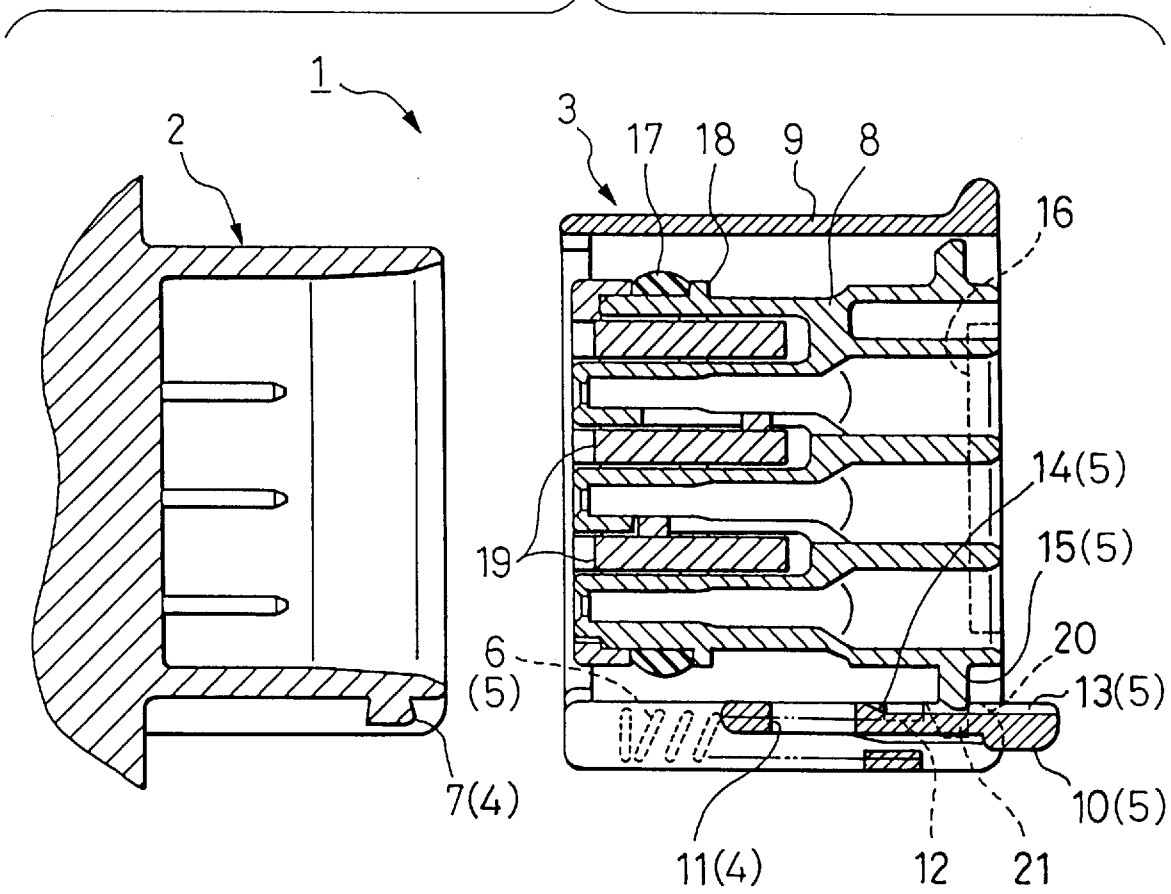
FIG. 2 is a sectional view showing the embodiment of the half-fitting preventing connector according to the present invention.
Figure 3:
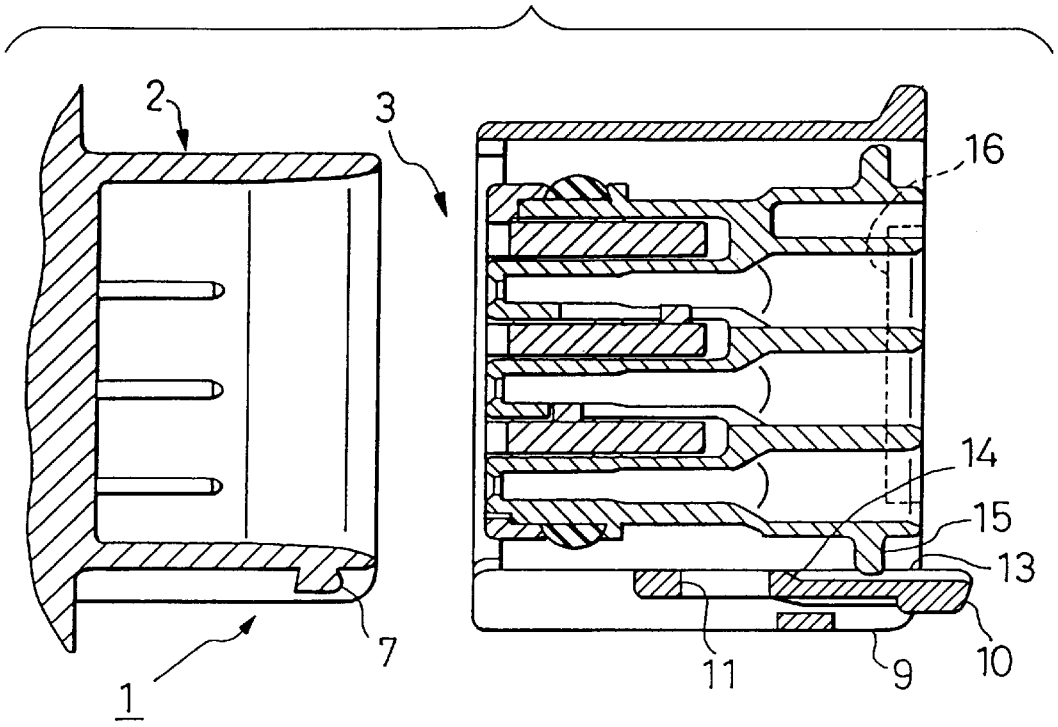
FIG. 3 is an operational explanatory view showing a state in which connectors depicted in FIG. 2 have not been fitted to each other yet.
Figure 4:
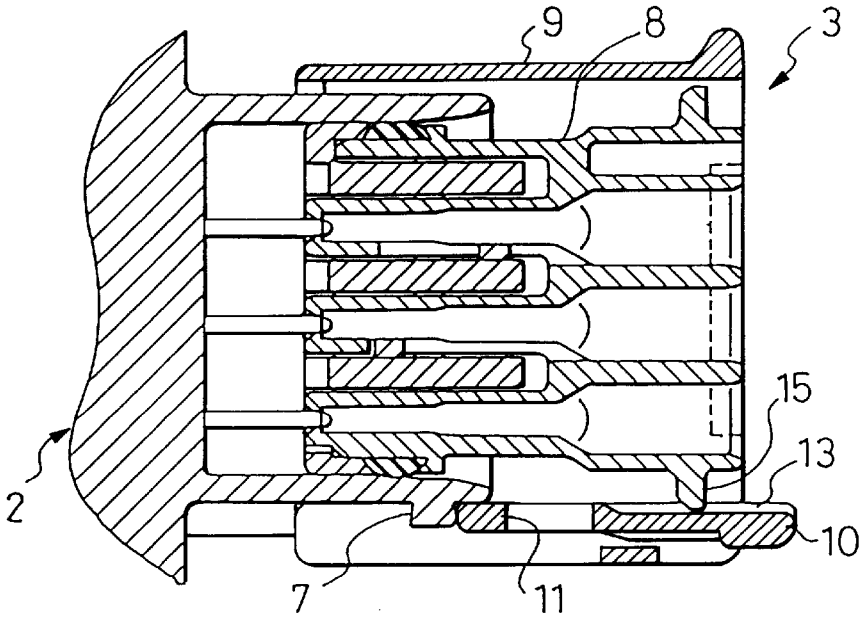
FIG. 4 is an operational explanatory view showing a state in which the fitting of connectors in FIG. 3 is started.
Figure 5:
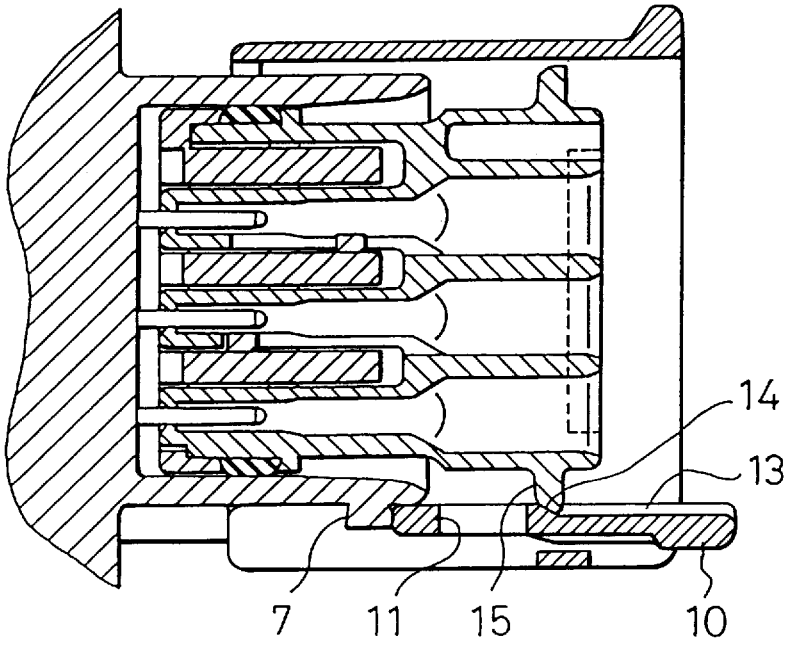
FIG. 5 is an operational explanatory view showing a state in which the fitting of connectors in FIG. 4 is being made.
Figure 7:
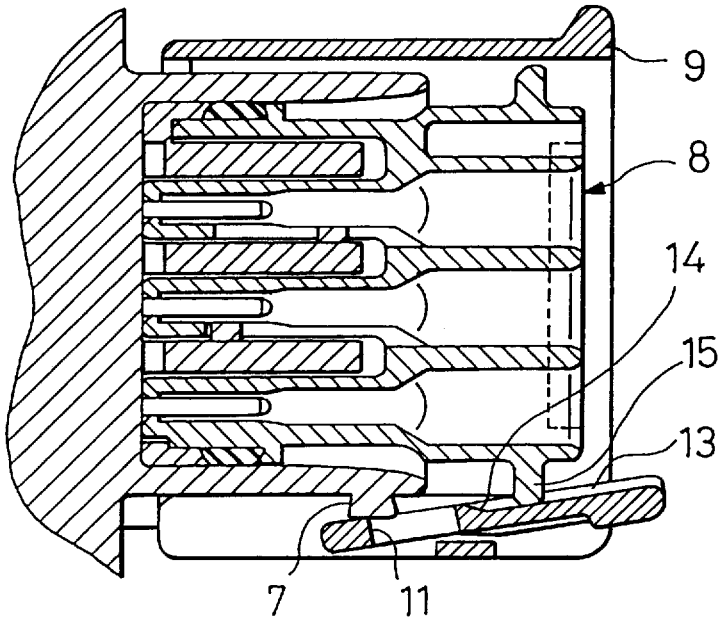
FIG. 7 is an operational explanatory view showing a state in which the tilting of the lock member in FIG. 6 is being made.
Figure 8:
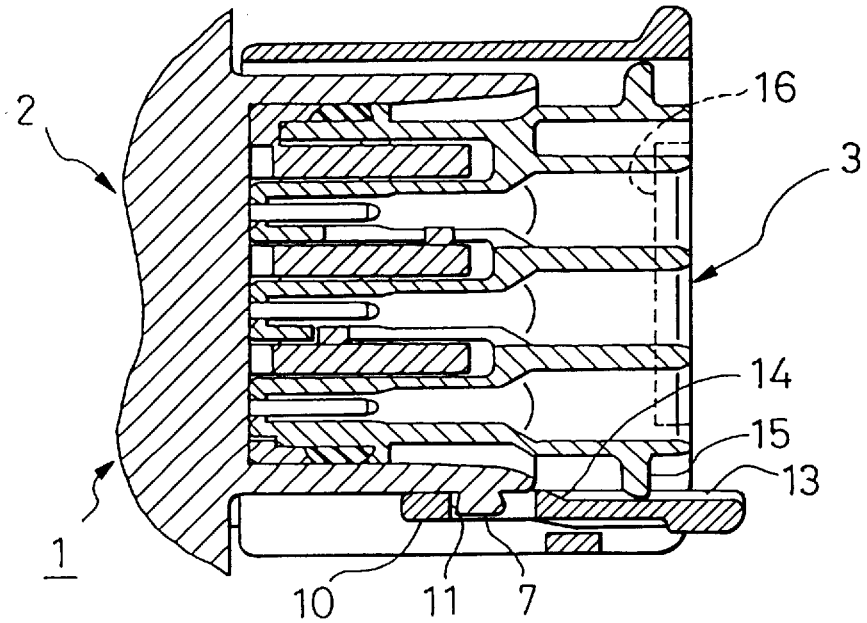
FIG. 8 is an operational explanatory view showing a state in which the fitting of the connectors in FIG. 7 is completed.
Figure 9:
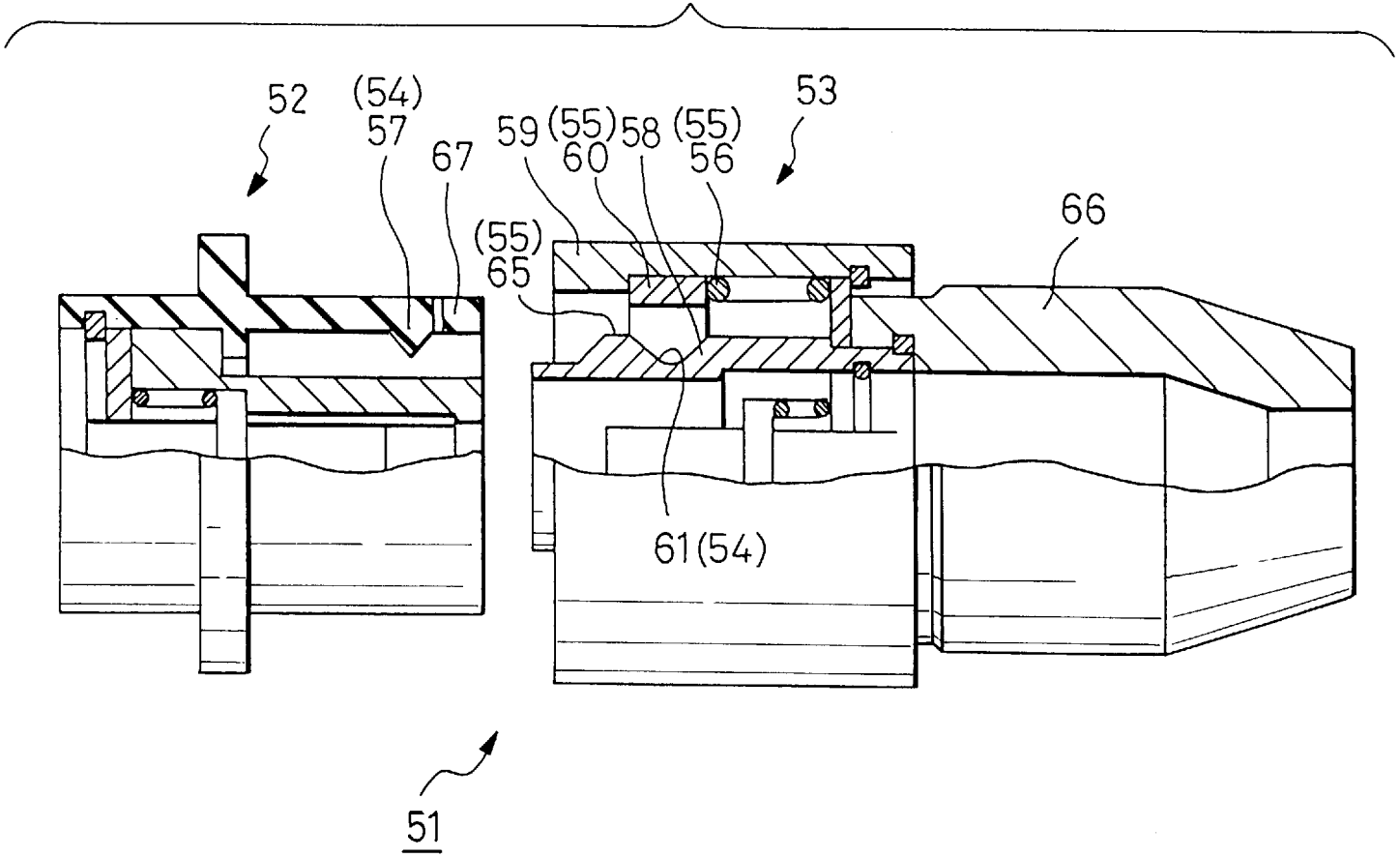
FIG. 9 is a sectional view showing an example of a conventional half-fitting preventing connector.

An embodiment of the half-fitting preventing connector according to the present invention will be described below in detail with reference to FIGS. 1 through 8. FIG. 1 is an exploded perspective view showing an embodiment of the half-fitting preventing connector according to the present invention; FIG. 2 is a sectional view showing the embodiment of the half-fitting preventing connector according to the present invention; FIG. 3 is an operational explanatory view showing a state in which connectors depicted in FIG. 2 have not been fitted yet; FIGS. 4 to 7 are operational explanatory views showing states in which the connectors depicted in FIG. 2 are in the way of fitting to each other; and FIG. 8 is an operational explanatory view showing a state in which the connectors depicted in FIG. 2 are perfectly fitted to each other.

The half-fitting preventing connector 1 shown in FIGS. 1 and 2 comprises a suitable number (in this embodiment, one pair) of engagement mechanisms 4 by which male and female connectors 2 and 3 to be fitted/connected to each other are engaged with each other in a perfect-fitting position, a suitable number (in this embodiment, one pair) of lock mechanisms 5 for locking the engagement mechanisms 4 in the perfect-fitting position, and a suitable number of compression springs (elastic members) (in this embodiment, two compression springs) 6 for holding the lock mechanisms 5 to be urged in the perfect-fitting position.

The engagement mechanisms 4 include a suitable number of inflexible engagement projections (in this embodiment, one inflexible engagement projection) 7, for example, formed from a hardened synthetic resin material and provided on an outer circumferential surface of the male connector 2, and an engagement hole 11 provided in a lock member 10 disposed in an outer housing 9 which are axially slidable on an outer circumferential surface of an inner housing 8 of the female connector 3.

Further, the lock mechanisms 5 include the lock member 10 which is held in the outer housing 9 so as to be able to be tilted by a flexible support portion 12 and which has two tilting grooves 13 formed in its inner surface so that the front end of the lock member 10 starts from a curved taper surface 14, and two tilting projections 15 which are provided on the outer circumferential portion of the inner housing 8 so as to be slidably engaged with the tilting grooves 13.

More specifically, the aforementioned tilting projections 15 are provided also on the inner housing 8 so as to be symmetric in position with each other. This is because one of the tilting projections 15 is provided preparatorily so as to cope with the case where the inner housing 8 is inserted in the outer housing 9 turned upside down. Further, grip members 16 are provided on the upper and lower portions of the rear end of the inner housing 8 so as to project so that the partner male connector 2 can be easily pressed into when the partner male connector 2 is fitted/connected to the female connector 3. Further, a stopper 18 for stopping a packing 17 is provided on the outer circumference of the front portion of the inner housing 8 so that the packing 17 is nipped between the stopper 18 and a spacer 19 attached from the front side. Further, an engagement hook 20 is provided at the rear end of the outer housing 9 so as to be engaged with an engagement step 21 at the rear end of the inner housing 8.

In the half-fitting preventing connector 1 according to the aforementioned embodiment, after the packing 17 is first fitted to the inner housing 8 and the spacer 19 is attached, the outer housing 9 is fitted to the inner housing 8 from the front side through the compression springs 6 and the engagement hook 20 is engaged with the engagement step 21, thereby completing assembling of the female connector 3.

The fitting/connecting operation of the male and female connectors 2 and 3 will be described below with reference to FIGS. 3 through 8. First, the female connector 3 is pressed so as to be fitted to the male connector 2 by using the grip members 16. In a stage shown in FIG. 4, the engagement projection 7 abuts on the front end of the lock member 10. Further, in a stage shown in FIG. 5, the outer housing 9 is pressed backward through the lock member 10, so that not only the tilting projection 15 abuts on the taper surface 14 of the tilting groove 13 but also the compression springs 6 are compressed. Accordingly, if the hand's hold is released in the half-fitting state, the male and female connectors 2 and 3 repulse each other so as to be disconnected from each other.

Figure 6:
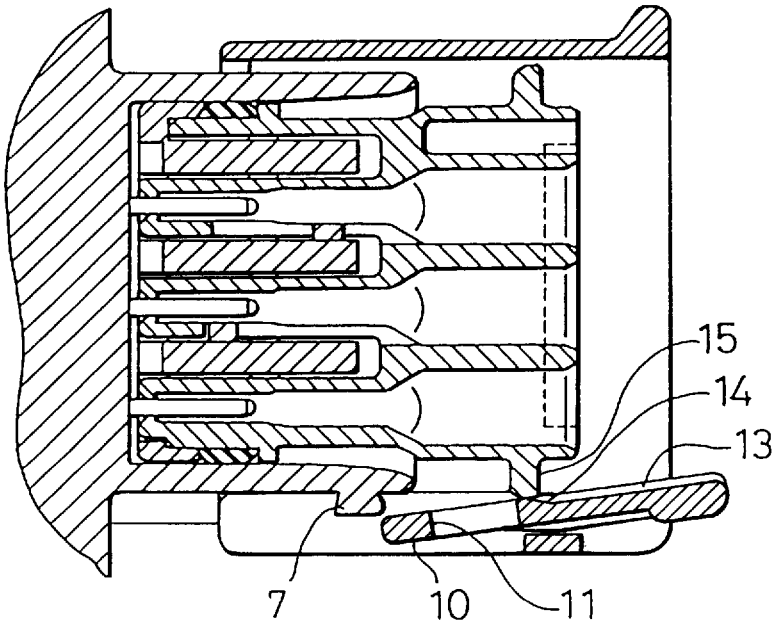
FIG. 6 is an operational explanatory view showing a state in which the tilting of the lock member in FIG. 5 is started.

Next, in such a stage as shown in FIG. 6, the tilting projection 15 slides on the taper surface 14 so as to be disconnected from the tilting groove 13, so that the lock member 10 is tilted outward while distorting the flexible support portion 12. Because, in this occasion, the front end of the lock member 10 is disconnected from the engagement projection 7, the outer housing 9 pressed backward is turned forward as shown in FIG. 7 by the urging force of the compression springs 6. In a stage shown in FIG. 8, the tilting of the lock member 10 is returned by the urging force of the flexible support portion 12, so that the engagement hole 11 is engaged with the engagement projection 7. Accordingly, not only the male and female connectors 2 and 3 are fitted perfectly to each other but also the engagement mechanisms 4 are locked securely by the lock mechanisms 5.

Incidentally, if the perfect-fitting state of the male and female connectors 2 and 3 is to be released, first, the engagement hole 11 is disconnected from the engagement projection 7 by pulling the female connector 3 from the male connector 2 while pushing the rear end of the lock member 10 inside and gripping the grip members 16 of the female connector 3. Accordingly, when the female connector 3 is further pulled, the connector state is turned from the state shown in FIG. 7 back to the state shown in FIG. 6 while the compression springs 6 are compressed. Then, the lock member 10 is returned to an axially parallel state by the urging force of the flexible support portion 12. When the hand's hold of the grip members 16 is released, the front end of the lock member 10 is brought into contact with the engagement projection 7 so that the female connector 3 is disconnected from the male connector 2 by the urging force of the compression springs 6.

According to the above description, because the engagement projection 7 is provided on the outer circumferential surface of the male connector 2 whereas the engagement hole 11 is provided in the lock member disposed on the outer housing 9 of the female connector 3, the perfect-fitting state can be confirmed from the outside.

Furthermore, because the engagement projection 7 may be formed from a hardened synthetic resin material, the male connector 2 can be used also as a connector of the type which is directly fixed to an apparatus.

Furthermore, because the lock member 10 in the perfect-fitting state is never tilted by any means other than the tilting projection 15, the lock mechanisms 5 are not released by any external force. Accordingly, it is possible to obtain an half-fitting preventing connector with high reliability.

Further, because the lock member 10 is held in the outer housing 9 so as to be able to be tilted and not so as to project on the inner circumferential portion, any clearance is not required to be formed between the inner housing 8 and the outer housing 9, so that reduction in size of the connector can be attained.

Incidentally, the present invention is not limited to the aforementioned embodiment and can be carried out also in other embodiments if suitable changes may be made. Although this embodiment has shown an example in which a pair of engagement mechanisms 4 and a pair of lock mechanisms 5 are provided on respective one sides of male and female connectors 2 and 3, the present invention can be applied also to a case where two pairs of engagement mechanisms 4 and two pair of lock mechanisms 5 are provided in opposite sides of the housings. In this case, an engagement force balanced between left and right can be obtained but it is necessary, from the point of view of strength, that the same reinforcing member as that is provided on the outer circumference of the rear portion of the outer housing 9 is also provided on the outer circumference of the front portion of the outer housing 9.

Although this embodiment has shown the case where a curved taper surface is provided on the front end of the tilting groove, the present invention may be applied also to a case where a linear taper surface is provided.

As described above, in the half-fitting preventing connector according to the preset invention, the engagement mechanisms include an inflexible engagement projection provided on the outer circumferential surface of the male connector, and an engagement hole provided in the lock member of the outer housing which is slidable axially on the outer circumference of the inner housing of the female connector.

Accordingly, because not only the perfect-fitting state can be confirmed easily from the outside but also the engagement projection is inflexible so that the male connector can be used also as a male connector of the type which is directly fixed to an apparatus, both reliability and general-purpose property of the connector are improved.

Furthermore, the lock mechanisms include a lock member held on the outer housing so as to be able to be tilted and having a tilting groove in its inner surface, tilting projection provided on the outer circumferential portion of the inner housing, and elastic members attached to urge the outer housing to the front of the inner housing.

Accordingly, because the lock member in the perfect-fitting state is never tilted by any means other than the tilting projection, the lock mechanisms are never released by any external force so that a more reliable connector can be obtained.

Furthermore, because the lock member is held on the outer housing so as to be able to be tilted and not so as to project to the inner circumferential portion, no clearance is required to be provided between the inner housing and the outer housing. Accordingly, reduction in size of the connector can be attained.

Furthermore, because a taper surface is provided on the front end of the tilting groove, the lock member can be tilted smoothly by the tilting projection as the connectors are fitted to each other. Accordingly, the work of fitting the connectors to each other can be made easily, so that improvement in workability can be attained.

It is claimed:

1. A connector comprising:

a first connector;

a second connector mateable with said first connector, said second connector including an inner housing and an outer housing which are slidably disposed with respect to each other in a longitudinal direction;

a biasing member contacting said inner and outer housings for urging said inner and outer housings away from each other; and a locking mechanism for locking said second connector to said first connector in a completely engaged position, said locking mechanism including a lock arm provided on said outer housing and having an aperture therein and a locking projection provided on said first connector for engaging said aperture, said locking projection being received in said aperture when said first and second connectors are in said completely engaged position.

2. The connector of claim 1, wherein said biasing member is a spring.

3. The connector of claim 2, wherein said spring urges said inner housing in a first direction away from said first connector.

4. The connector of claim 3, wherein said spring urges said outer housing in a second direction toward said first connector.

5. The connector of claim 4, wherein one end of said spring abuts against said inner housing and an opposite end of said spring abuts against said outer housing.

6. The connector of claim 4, wherein said lock arm is pivotally secured to said outer housing.

7. The connector of claim 6, wherein said inner housing includes a tilting projection and said lock arm includes a tapered surface upon which said tilting projection slides during engagement of said first and second connectors with each other and attendant relative movement between said inner and outer housings.

8. The connector of claim 7, wherein said tilting projection deflects said lock arm to allow a distal end thereof to pass by said locking projection upon said mating of said first and second connectors.

9. The connector of claim 2, wherein said locking projection is visible from the outside when said projection is received in said aperture such that said completely engaged position can be visually confirmed.

10. The connector of claim 8, wherein upon movement of said inner housing in said first direction toward said first connector, said locking projection abuts against a distal end of said locking arm to prevent movement of said outer housing with respect to said first connector.

11. The connector of claim 10, wherein upon a predetermined amount of relative movement of said inner housing with respect to said outer housing, said tilting projection deflects said lock arm whereupon said outer housing moves in said second direction to allow engagement of said locking projection in said aperture.

* * * * *